United States Patent [19]

Whitmarsh

[11] 4,184,693

[45] Jan. 22, 1980

[54] TRUCK FOR A SKATEBOARD

[75] Inventor: Denis H. Whitmarsh, Carpenders Park, England

[73] Assignee: Lexique Limited, Harrow, England

[21] Appl. No.: 903,739

[22] Filed: May 8, 1978

[30] Foreign Application Priority Data

Nov. 9, 1977 [GB] United Kingdom ..... 46654/77

[51] Int. Cl.[2] ..... A63C 17/02

[52] U.S. Cl. ..... 280/11.28; 280/87.04 A

[58] Field of Search ..... 280/11.28, 11.27, 11.21, 280/11.19, 87.04 R, 87.04 A, 111, 112 R, 112 A

[56] References Cited

U.S. PATENT DOCUMENTS

| | | | |
|---|---|---|---|
| 277,911 | 5/1883 | Lutz | 280/11.28 |
| 304,949 | 9/1884 | Mitchell | 280/11.28 X |
| 4,054,297 | 10/1977 | Solimine | 280/11.28 X |
| 4,120,508 | 10/1978 | Brown et al. | 280/87.04 A X |

*Primary Examiner*—Robert B. Reeves
*Assistant Examiner*—Gene A. Church
*Attorney, Agent, or Firm*—Fleit & Jacobson

[57] ABSTRACT

In a truck having a base plate for securing to the underside of a skateboard deck, a spring member such as a plate spring is joined to the base plate by one end and carries a wheel axle near an opposite end. The axle-carrying end is flexed away from the base plate to be biassed into engagement with a post secured to the base plate to depend from it. In use, the spring member is adapted to twist about its longitudinal axis whenever the skater shifts his weight on the deck, the spring member riding on the post either directly or through the intermediary of a bearing member.

11 Claims, 8 Drawing Figures

TRUCK FOR A SKATEBOARD

The invention relates to a truck for a skateboard.

The sport of skating on land by means of a single board comprising a so-called deck which is provided with rollers known as wheels and on which the feet of the user rest freely without the use of bindings is becoming increasingly popular and sophisticated. Serious skaters nowadays assemble their skateboards from separately purchased components which they carefully select to meet their own particular needs or taste. Considerable advances have, for instance, been made in the design of the deck and the wheels. However, the most critical aspect of skateboard design which has undergone little change despite ample room for improvement is probably the manner in which the wheels are attached to the deck so as to permit the skater to exert sensitive steering forces at high and low speeds simply by shifting his weight on the deck.

The wheels are suspended in pairs from the underside of the deck by means of a bogie or undercarriage commonly known as a truck, there being one truck near the front and one near the back of the deck. Practically all trucks for skateboards, whether for serious competitive sport or pleasure use, comprise a mounting plate, known as a base plate, for bolting to the underside of the deck, a socket which may contain a bearing bush or liner and is formed in a block known as a yoke moulded integrally with the base plate and depending therefrom as an angled projection, and a little spindle arm known as a hanger which is provided with a fixed axle for rotatably mounting one of the wheels at each end. At one side, the hanger is formed with an obliquely extending integral pivot pin which is seated in the socket. At the opposite side, the hanger is formed with a transverse integral hoop. The hoop surrounds a suspension bolt or king pin which depends from the base plate and has its shank engaged in a tapped hole of the yoke. On the bolt, two coaxial rubber sleeves are held between two steel washers and the hoop of the hanger embraces the sleeves at their junction. The sleeves can be expanded radially for a tighter fit in the hoop by compressing them axially between the washers, such compression being effected by tightening the suspension bolt in the tapped hole of the yoke.

In use, as the skater shifts his weight from the middle to one side of the deck, the hanger is caused to swivel about its pivot pin out of a neutral position for straight ahead travel and hence the wheels carried by the axle of the hanger together change their direction relatively to the deck, which consequently changes the direction of travel of the skateboard. The desired yieldable resistance to the swivelling motion of the hanger from either side of the neutral position is exerted between the hoop, which swivels together with the hanger because it is made in one piece with it, and the rubber sleeves, which are held stationary by the suspension bolt and become distorted as the hanger is being swivelled. This resistance is a matter of personal preference by the skater and the amount of sleeve distortion can be adjusted before use by further tightening or loosening of the suspension bolt, thereby varying the degree of radial expansion of the sleeves and the tightness of their fit in the hoop. When the skater wishes to travel straight ahead again, he returns his weight to the middle of the deck, the hanger pivoting back to the neutral position under the resilience of the rubber sleeves which resume their undistorted state.

The known form of truck described above has remained practically unchanged since skateboarding was in its infancy and suffers from several disadvantages which have been discovered by users and safety experts alike. First, it has been found that pre-adjustment of the rubber sleeves, although unanimously pronounced by experts to be critical, is a cumbersome and delicate operation and can in fact seldom be effected to give exactly the required result. If the hoop of the hanger is too slack around the sleeves, that is to say if the sleeves have been only slightly radially expanded so as to make it easy to steer the skateboard, there is dangerous wheel or hanger wobble, especially when travelling over uneven ground, and this upsets the balance of the skater. On the other hand, if wheel wobble is to be eliminated, the sleeves have to be pre-expanded to such an extent that the skateboard becomes stiff to steer and the skater loses a great deal of essential manoeuverability through insensitivity in steering control.

Another disadvantage of the known truck is that the rubber of the sleeves tends to deteriorate rather quickly under fatigue stress and perish even more quickly if the sleeves come into contact with oil or other harmful chemicals flung up from the road surface, the sleeves becoming progressively more sluggish in resuming their undistorted state for straight ahead travel (loss of memory). Also, the known truck construction is relatively expensive because it involves the manufacture of at least two components by metal casting in aluminum alloy (the base plate with yoke and the hanger with hoop). This is not assisted by the fact that, for special kinds of skating which demand the use of wider wheels, it is necessary to have different moulds to provide hangers of different lengths.

Particularly the Royal Society for the Prevention of Accidents has criticized skateboard constructions and the sudden upredictable failure of critical components produced by casting was named as a potential source of danger by the Fulmer Research Institute. Base plates and hangers made as gravity, pressure die and sand castings have been known to snap or shatter in use and it has been reported that some trucks cracked and disintegrated in a matter of days.

Further, in a conventional truck the axle is embedded in the hanger during casting and cannot be replaced or replaced only with difficulty if it is splined. However, even the best quality steel axle is liable to become damaged by bending or stripping of its screwthreads and the truck is then unsafe.

Yet another major problem with known trucks is that, during extreme swivelling of the hanger, the wheels touch the underside of the deck, they jam, and create a hazardous situation. This danger cannot be avoided except by very thick riser pads inserted between the base plate and the deck and therefore skaters are encouraged to gouge wheel wells out of the underside of the deck, which of course drastically weakens the deck and aggravates the safety hazards.

In its preferred embodiment, the invention aims to avoid most of the above-mentioned disadvantages.

According to the invention, a truck for a skateboard comprises a base plate for securing to the underside of the deck, a spring member joined to the base plate at a first location by one end and carrying a wheel axle near an opposite end, and a post depending from the base plate at a second location spaced from the first, the spring member being prestressed by its axle-carrying end being flexed away from the base plate so that it is biassed into engagement with the post.

By reason of the fact that the wheel axle is carried by a preflexed spring member, which may be a plate spring integral with the base plate but is preferably separately made and secured thereto, the truck according to the invention dispenses with a pivot pin rotatable in the lined socket of a yoke, with a cast hanger as well as with the conventional rubber sleeve and hoop suspension and consequently with the need for adjustment by the user. A skateboard deck fitted with two of the trucks is steered, as hitherto, by the skater shifting his weight on the deck, or rather leaning to one side or the other. This causes the plate spring to twist and change the direction of the axle but it will remain engaged with and supported by the post on which it rides directly or indirectly whilst the spring is being twisted or untwisted. Steering control of the required sensitivity is obtainable by the skater without adjustment of the spring or any other part. Since there is no need for a hanger which is integral with a pivot pin and a hoop, the axle carried by the plate spring can easily be replaceably secured to the spring.

A plate spring preferred in accordance with the present invention returns more promptly to the untwisted condition than does a rubber sleeve, i.e. it has a superior memory characteristic. Desirably, the spring is made from polypropylene. This material has the advantage of an exceptionally high fatigue strength and, even if it is overloaded, it will not snap suddenly but yield gradually, which is most important from a safety point of view. What is more, polypropylene has the property of giving visible signs of eventual weakening by becoming discoloured at the overstressed areas.

Examples of the invention are shown in the accompanying drawings wherein.

Figure 1:
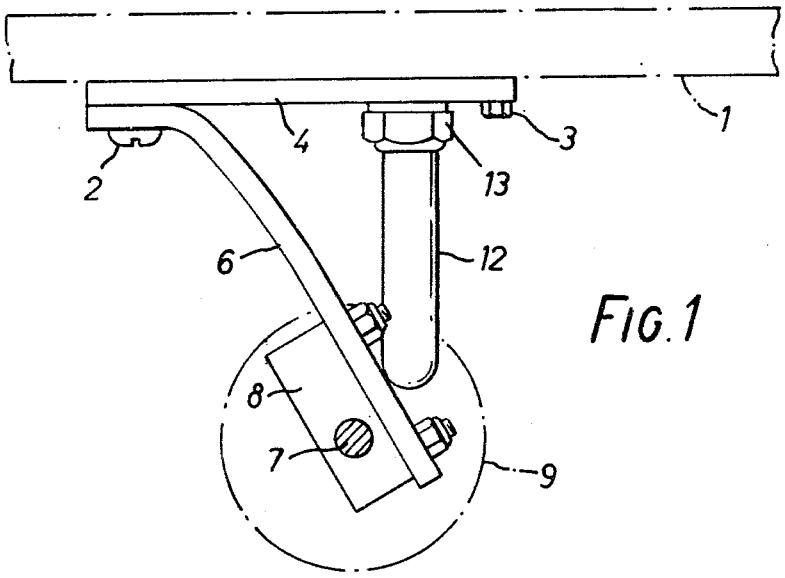
FIG. 1 is a side elevation of a truck for a skateboard deck, the latter being indicated in chain-dotted lines, as is one of the wheels.
Figure 2:
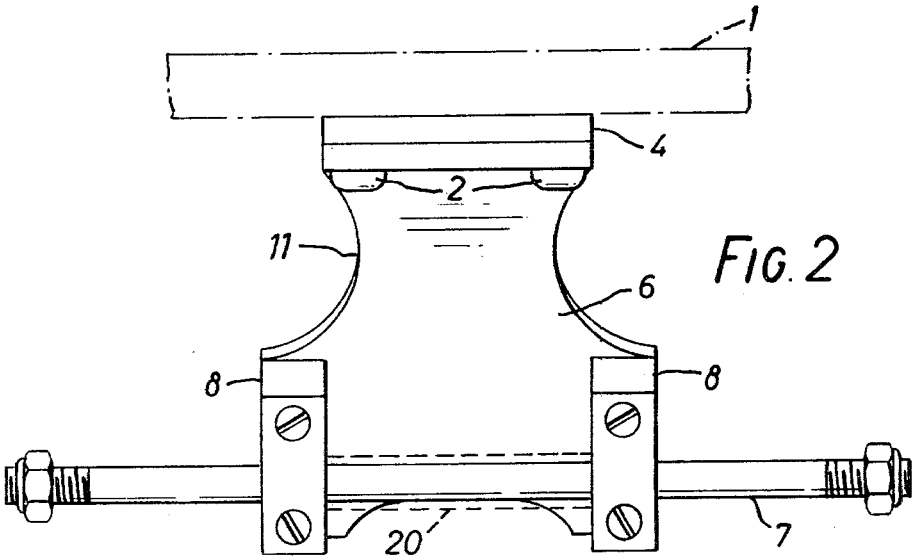
FIG. 2 is a front elevation of the FIG. 1 truck.
Figure 3:
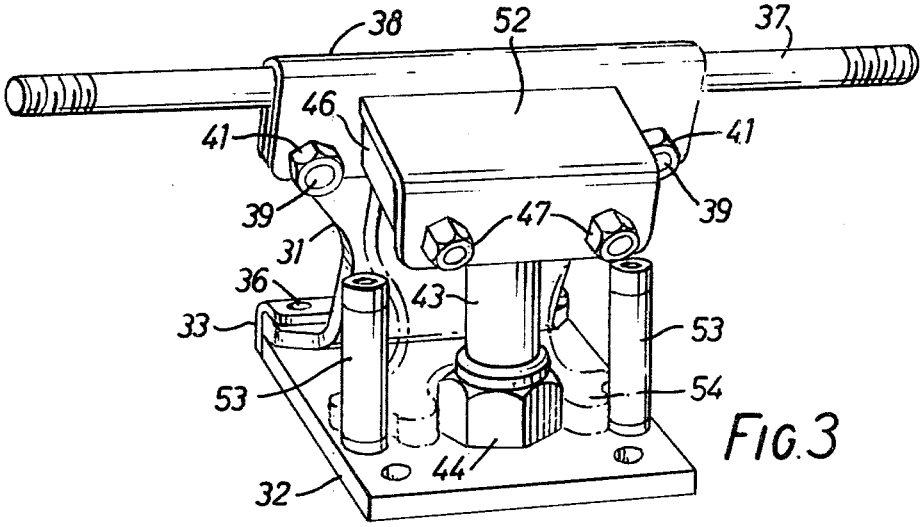
FIG. 3 is an inverted perspective view of a preferred second embodiment of a skateboard truck.

Referring to FIGS. 1 and 2, the illustrated truck is intended to be secured to the underside of a skateboard deck 1 such as by bolts 2 and 3 passing through holes in a mounting or base plate 4. There are two trucks per board (only one is shown) and they are often purchased separately from the deck and from the wheels. The bolts 2 also serve to connect one end of a polypropylene plate spring 6 to the plate 4. The other end of the plate spring carries an axle 7 which is fixed in connecting blocks 8 bolted to the plate spring. The user attaches a wheel or roller 9 of his own choice to each end of the axle.

The plate spring 6 is prestressed by being flexed to depend obliquely away from the base plate 4 and bear against the rounded tip of a post 12 which also depends from the plate 4 at a spacing from the bolts 2. The post 12 is screwed into a tapped hole of the plate 4 and held in a fixed position by a lock nut 13.

In use, when the skater leans to one side to make his weight bear more on one side of the deck 1 than the other, the plate spring 6 is caused to twist about its longitudinal axis, whilst remaining in contact with the post 12, on which it rides. Such twisting swivels the axle 7 carried thereby, so that the wheels 9 assume a different direction. The plate spring 6 has a waisted portion 11 which has the effect of making it easier to twist about its longitudinal axis and thereby provide easier steering control. A spacer sleeve 20 between the blocks 8 ensures that twisting of the plate spring is confined to the waist.

In a modification (not shown in FIGS. 1 and 2) means are provided to prevent the plate spring from being flexed excessively far away from the bearing post under unusual conditions of use, for example if the wheels strike an obstacle. Such means may be a back stop in the form of a strut which is loosely looped around the spring and restricts further flexure in a clockwise direction as viewed in FIG. 1 after its axle-carrying end has moved a few millimeters out of contact with the post 12.

A second and preferred example of the invention is illustrated in FIGS. 3 to 7 of the drawings. The principle of construction and operation of this truck is the same as the FIGS. 1 and 2 embodiment but there are some refinements. A waisted polypropylene plate spring 31 is anchored at one end to a mounting or base plate 32 by an angle 33, the angle being tightened onto the base plate by a bolt 34 which passes through the spring and is screw-threadedly engaged in a tapped hole of the base plate. This connection between the spring and base plate is strengthened when the user subsequently secures the base plate to the underside of the deck (not shown) by bolts (not shown) passing through aligned holes 36 (only one is visible in FIG. 3) in the angle, spring and base plate.

At the end of the spring 31 opposite to where it is clamped to the base plate 32, the spring has a wheel axle 37 releasably fixed to it by a U-shaped strap 38 having two bolts 39 passing through the limbs of the U and through the spring and secured by self-locking nuts 41. A shim between one limb of the strap 38 and the spring 31 is indicated at 42. The axle 37 is very securely held to the spring by being clamped between the limbs of the strap 38 as well as between the web of the strap and the adjacent end of the spring. A post 43 depending from the base plate 32 at a spacing from the bolt 34 is screw-threadedly engaged in a tapped hole of the base plate and secured by a lock nut 44.

Instead of bearing directly on the free end of the post as in FIGS. 1 and 2, the FIGS. 3 to 8 construction provides an interposed nylon bearing member 46 which is in the form of a block secured to the spring 31 by self-locking nuts 47 on the shanks of two bolts 48 passing through holes 49 in the bearing member and aligned holes in the strap 38 and spring 31. The tip of the post 43 is captive in an aperture 51 of the bearing member 46.

As in the previously described construction, the spring 31 is pre-stressed so as to be biased into engagement with the post 43 but it rides on the post through the intermediary of the bearing member 46. By reason of the post being captive in the bearing member, the latter also serves as means preventing the spring from being flexed out of contact with the post under unusual conditions of use. An L-shaped cover plate 52 is included to act as a shield for the bearing member and it is secured in place by the self-locking nuts 47.

Another refinement in this second embodiment is the provision of two abutments 53 depending from the base plate, one to each side of the post 43, to serve as stops for limiting the amount to which the spring 31 can be twisted about its longitudinal axis out of its illustrated neutral position. The length of the abutments is such that the wheels will not rub on the underside of the deck to which the base plate is secured with a riser pad of about ¼ inch interposed therebetween. The abutments are screw-threadedly engaged in tapped holes of the base plate.

Figure 7:
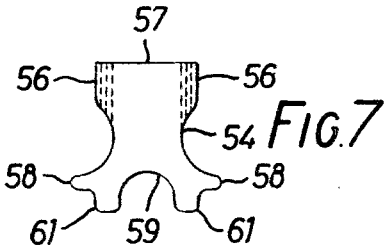
FIG. 7 is a reduced inverted front elevation of the stiffener insert.
Figure 8:
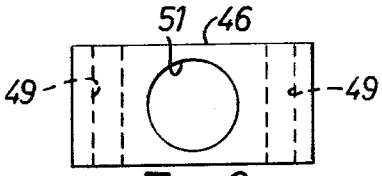
FIG. 8 is a plan view of a bearing member.
Figure 4:
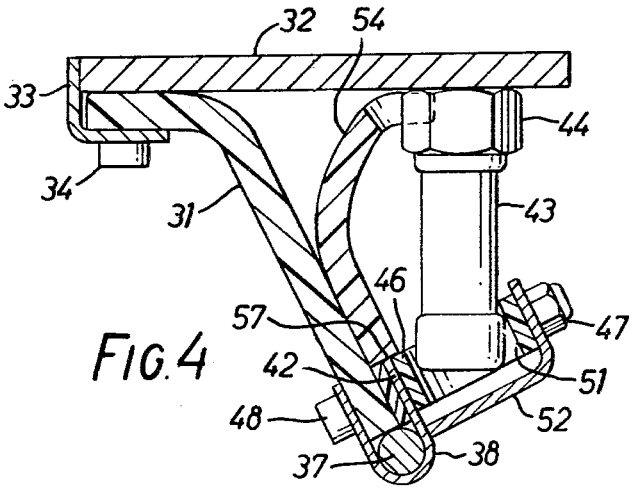
FIG. 4 is a sectional side elevation of the FIG. 3 truck.
Figure 5:
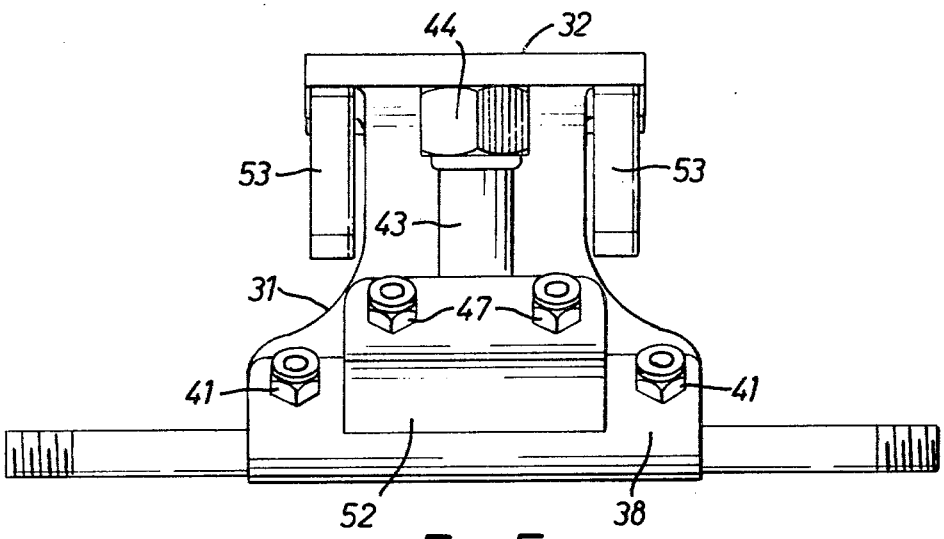
FIGS. 5 and 6 are respectively an end elevation and side elevation of the FIGS. 3 and 4 truck but omitting a removable stiffener insert.
Figure 6:
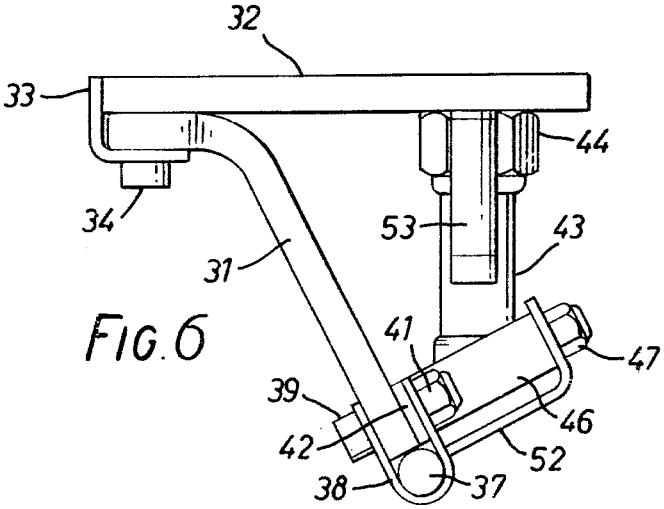

The invention provides a durable skateboard truck which permits the axle to be changed rapidly, requires no adjustment and yet provides hair-trigger steering response without wheel wobble. In some instances, e.g. bowl riding or for learners, it is not desired to have such supersensitive steering control. For this purpose, the flexibility of the plate spring 31 can be reduced by installing an adjacent stiffener insert in the form of a flexible waisted plate 54 of polypropylene. This insert is best shown in FIG. 7 in inverted front elevation. At one end, the plate 54 is formed with shoulders 56 adjoining a straight edge 57. These are followed by the waisted plate portion which merges with an outwardly directed transverse heel 58 at each side. At the end opposite the shoulders, the plate is formed with a recess 59 defining toes 61 at right-angles to the respective heels. In side elevation, the stiffener insert is curved in the as-made condition, the shape being evident from the cross-section of FIG. 4. In contrast, very little pre-curvature is given to the plate spring 31, most of the flexure being applied only during assembly.

To fit the stiffener insert, the nylon bearing member 46 and cover plate 52 are temporarily moved by loosening the nuts 47. The plate spring 31 is then pulled away from the post 43 to make room for inserting the plate 54 and locating it so that its edge 57 rests on one limb of the axle strap 38 and the shim 42 and each heel 58 rests against a respective abutment 53, with each toe disposed between the nut 44 and one of the abutments. Of course the insert can be removed again when necessary. If the steering response with the stiffener included is too stiff, or as a learner gains experience and wishes to increase the steering sensitivity, he can do his own precision tuning by progressively shaving equal amounts off the end of the shoulders 56, i.e. the sides of the plate 54, as shown in broken lines in FIG. 7. The more material is removed, the greater will be the steering control.

It will be evident that, in use, the stiffener insert also twists about its longitudinal axis whenever the plate spring 31 is caused to twist by the skater, the combined effect of the stiffener and spring being to require a more concerted effort on the part of the skater to change the direction of travel of the board than when the spring 31 is used without the insert. By reason of the locating heels 58 and toes 61, the insert is not required to be bolted in position and it will not become dislodged on twisting.

The preferred material for the base plate, axle strap and cover plate is aluminum alloy because a low weight is an important factor for skateboard components.

I claim:

1. A truck for a skateboard deck, comprising a base plate for securing to the underside of said deck, a spring member joined to said base plate at a first location by one end and carrying a wheel axle near an opposite end, said spring member comprising a plate spring, a post depending from said base plate at a second spaced from said first location, said spring member being pre-stressed by its said axle-carrying end being flexed away from said base plate so that it is biassed into engagement with said post, and a stop means preventing flexure of said plate spring out of engagement with said post.

2. A truck for a skateboard deck, comprising a base plate for securing to the underside of said deck, a spring member joined to said base plate at a first location by one end and carrying a wheel axle near an opposite end, said spring member comprising a plate spring, a post depending from said base plate at a second location spaced from said first location, said spring member being pre-stressed by its said axle-carrying end being flexed away from said base plate so that it is biassed into engagement with said post, and a bearing member secured to said plate spring at its said opposite end so as to ride on said post.

3. A truck for a skateboard deck, comprising a base plate for securing to the underside of said deck, a spring member joined to said base plate at a first location by one end and carrying a wheel axle near an opposite end, said spring member comprising a plate spring, a post depending from said base plate at a second location spaced from said first location, said spring member being pre-stressed by its said axle-carrying end being flexed away from said base plate so that it is biassed into engagement with said post, and abutments depending from said base plate to serve as stops for limiting twisting of said plate spring.

4. A truck for a skateboard deck, comprising a base plate adapted to be secured to the underside of said deck, a plate spring joined by one end to said base plate at a first location, a wheel axle carried by said spring near an opposite end thereof, and a post fixed to depend from said base plate at a second location, said spring being permanently stressed as a result of its said opposite end being flexed away from said base plate out of an unflexed position so that it is permanently biassed towards said post and is held away from said unflexed position by the tip of said post.

5. The truck as defined in claim 4 including a bearing member secured to said plate spring at its said opposite end so as to ride on said post.

6. The truck as defined in claim 4, including abutments depending from said base plate to serve as stops for limiting twisting of said plate spring.

7. The truck as defined in claim 2 or claim 5, wherein said bearing member is of nylon.

8. The truck as defined in claim 2 or claim 5, wherein said bearing member is a block containing an aperture in which the tip of said post is captive.

9. The truck as defined in claim 5 or claim 6, including a removable stiffener insert disposed adjacent said plate spring and having locating heels and toes engaged with said abutments.

10. The truck as defined in claim 4, wherein said plate spring is of polypropylene.

11. The truck as defined in claim 4, wherein said axle is releasably clamped to said plate spring by a U-shaped strap.

* * * * *